US007934275B2

(12) United States Patent
Ullensvang Helgeland

(10) Patent No.: US 7,934,275 B2
(45) Date of Patent: May 3, 2011

(54) COLLAPSIBLE SUSPENSION BED

(75) Inventor: Mari Synnove Ullensvang Helgeland, Stavanger (NO)

(73) Assignee: Mari Design, Mari Helgeland (NO)

( * ) Notice: Subject to any disclaimer, the term of this patent is extended or adjusted under 35 U.S.C. 154(b) by 0 days.

(21) Appl. No.: 12/666,662

(22) PCT Filed: Jun. 26, 2008

(86) PCT No.: PCT/NO2008/000238

§ 371 (c)(1),
(2), (4) Date: Sep. 27, 2010

(87) PCT Pub. No.: WO2009/002188

PCT Pub. Date: Dec. 31, 2008

(65) Prior Publication Data

US 2011/0016629 A1 Jan. 27, 2011

(30) Foreign Application Priority Data

Jun. 27, 2007 (NO) ..... 20073281

(51) Int. Cl.
*A45F 3/22* (2006.01)

(52) U.S. Cl. ..... 5/120; 5/122; 5/101

(58) Field of Classification Search ..... 5/98.3, 5/101, 102, 120, 122, 123
See application file for complete search history.

(56) References Cited

U.S. PATENT DOCUMENTS

| | | | | | |
|---|---|---|---|---|---|
| 1,039,944 | A | * | 10/1912 | Hohlfeld | 5/98.3 |
| 1,237,628 | A | * | 8/1917 | Ford | 5/98.3 |
| 1,376,476 | A | * | 5/1921 | Stepke | 5/98.3 |
| 1,463,500 | A | * | 7/1923 | Burroughs | 5/1 |
| 4,375,110 | A | | 3/1983 | Murphy | |
| 4,550,456 | A | * | 11/1985 | Allen | 5/98.3 |
| 5,170,520 | A | * | 12/1992 | Milliken | 5/98.3 |
| 5,511,258 | A | * | 4/1996 | Barr, Sr. | 5/104 |
| 5,729,844 | A | | 3/1998 | Kerstetter | |

FOREIGN PATENT DOCUMENTS

| | | |
|---|---|---|
| DE | 94 20 013 U1 | 2/1995 |
| GB | 296 279 A | 8/1928 |
| NO | 315142 B1 | 7/2003 |

OTHER PUBLICATIONS

International Search Report for patent application PCT/NO2008/000238, having a mailing date of Aug. 28, 2008.

* cited by examiner

*Primary Examiner* — Michael Trettel
(74) *Attorney, Agent, or Firm* — Andrus, Sceales, Starke & Sawall, LLP

(57) ABSTRACT

A collapsible suspension bed comprising a bed bottom, a bed wall including at least one end wall and at least two side walls, at least one support structure for the bed, and at least one suspension means connected to the support structure for suspension of the bed. The distinctive characteristic of the bed is that the volume of the bed is adjustable for volume-adjustment of the bed.

10 Claims, 8 Drawing Sheets

COLLAPSIBLE SUSPENSION BED

CROSS-REFERENCE TO RELATED APPLICATIONS

This application is the U.S. national stage application of International Application No. PCT/NO2008/000238, filed Jun. 26, 2008, which International application was published on Dec. 31, 2008, as International Publication No. WO 2009/002188 A1 in the English language, which application is incorporated herein by reference. The International application claims priority of Norwegian Patent Application No. 20073281, filed Jun. 27, 2007, which application is incorporated herein by reference.

AREA OF INVENTION

This invention concerns a collapsible suspension bed structured so as to be able to be suspended, when in position of use, from a suitable anchoring object, for example a ceiling, a beam or a stand.

The suspension bed may be a child bed, but it may also be used for other purposes, for example for keeping pets or objects.

BACKGROUND OF THE INVENTION

The origin of the invention is a need for being able to provide additional bed space in a small room, but also a need for being able to provide a flexible and simple bed capable of being adapted to the need of the user, and which is easy to move.

More specifically, the background of the invention is a need for being able to place a child bed, for example an infant bed, suspended above a parent bed in a room being too small to accommodate both beds. For reasons of size and safety, there is also a need for being able to expand such a suspended child bed as the child grows. Yet further, the suspension bed may be of a design allowing sideways access and/or visual access to the inside of the bed when in position of use, i.e. when the bed is suspended. By so doing, a child in the child bed may be removed and/or inspected without the care person having to leave said parent bed. This may be very advantageous, particularly at night.

PRIOR ART AND THE DISADVANTAGES THEREOF

The prior art comprises several collapsible suspension bed for small children.

As examples of such suspension beds, the following publications are mentioned:

DE 94 20 013 U1 (German utility model);

NO 315142 B1 (Norwegian patent);

U.S. Pat. No. 5,729,844 (American patent); and

U.S. Pat. No. 4,375,110 (American patent).

All of these publications describe collapsible and suspendable child beds comprising a flexible cloth, for example a textile cloth, attached to a support structure, for example one or several wooden poles or a plate, connected to a suspension means, for example ropes or a spring or similar, for suspension of the child bed.

However, none of these child beds are structured so as to be able to be expanded as the child grows. Thus, there is a need for a simple, flexible and collapsible suspensions bed capable at least of being expanded as required or desired.

THE OBJECT OF THE INVENTION

The object of the invention is to avoid or substantially reduce the disadvantages of the prior art in the present area.

HOW TO ACHIEVE THE OBJECT

The object is achieved by providing a new type of suspension bed comprising features as disclosed in the following description and in the subsequent claims.

The invention also assumes that a person skilled in the area will use relevant knowledge in the area, including various bed materials, connection means, attachment means, etc., to the degree required to adapt the invention to the specific conditions and needs. Such known equipment will not be discussed in detail given that this is considered known to the skilled person.

According to the invention a collapsible suspension bed is provided, comprising:

- a bed bottom;
- a bed wall including at least one end wall and at least two side walls;
- at least one support structure for the bed; and
- at least one suspension means connected to the support structure for suspension of the bed.

The distinctive characteristic of the invention is that the volume of the bed is adjustable for volume-adjustment of the bed.

In its position of use, the bed wall will appear with an upper and a lower edge. The bed volume being adjustable as such is defined by the bed wall, by the bed bottom and by the upper edge of the bed wall when this edge is located at its smallest distance from the bed bottom. This represents the minimum volume of the bed when in position of use.

Preferably, but not necessarily, the collapsible suspension bed is formed from a flexible material of suitable type and quality, for example a textile material. Such a flexible material is advantageous given that it is easy to fold and unfold during folding and unfolding of the bed. If required or desirable, one or several bed portions may also be padded and/or be provided with a netting material, etc. The suspension bed may also be provided with a mattress, various pockets and similar. Such features, however, do not relate to the essential part of the invention and will therefore not be discussed in further detail.

Said at least one support structure for the suspension bed may comprise support structures of the types discussed in said publications, i.e. one or several wooden poles, a plate or similar. However, the present suspension bed is not limited to such support structures. The suspension bed may also be of a fully or partially self-supporting design, at least when the bed is in position of use. This may be achieved by virtue of one or several elements of the bed wall and/or the bed bottom including materials and/or frame work structures having, or being structured so as to be able to have, sufficient stiffness and strength to allow them to withstand the loads for which the bed typically will be subjected to when in position of use. Thus, the bed wall and/or the bed bottom may include suitable elements, for example plates, struts and/or connecting links, which are formed from suitable materials, for example metal, wood, plastics, synthetic materials and/or other materials and/or material combinations. It is also conceivable to use inflatable elements for this purpose. In the event of using a self-supporting structure, the support structure must comprise elements that are flexible for allowing them to be folded, for example by virtue of the elements being pliable, hinged and/or link-connected.

In one embodiment, the bed wall may surround the entire bed bottom. In an alternative embodiment, the bed wall may surround a portion of the bed bottom, for example a mid-portion, whereby a peripheral edge of the bed bottom extends outside of the bed wall. If the bed bottom is structured as a load-bearing support structure for the bed, this peripheral bed bottom edge may be connected to at least one suspension means for suspension of the bed.

Such suspension means may comprise ropes, chains, straps, lines, struts, springs, quick couplings, hooks, screws, nuts, bolts, rivets, etc. These suspension means may also be assembled in various configurations, as desired or required. This includes using suspension means and configurations according to the aforementioned publications. The types of suspension means to be used are considered obvious to the skilled person and are of subordinate importance to the invention.

Moreover, the present suspension bed is not restricted to specific shapes, although some shapes may be more suitable than others in order to achieve, among other things, a cost-efficient production of the bed.

Thus, it may be advantageous for the bed bottom to have one of the following shapes:

square shape;
rectangular shape;
triangular shape;
oval shape; and
circular shape.

Reference is hereby made to the basic shape of the bed bottom prior to a potential change of its shape for volume-adjustment of the bed.

If the bed bottom has a square or rectangular shape, the bed wall will comprise two end walls and two side walls. If the bed bottom has a triangular shape, the bed wall will comprise one end wall and two side walls. And if the bed bottom has an oval or circular shape, the bed wall will comprise at least two (imaginary) end walls and at least two (imaginary) side walls, all of which have sliding transitions. Such a sliding (and thus imaginary) graduation of the bed wall may seem somewhat artificial, but this has been done in order to describe the invention with utmost clarity.

For adjustment of said bed volume, the height of the bed wall may be adjustable for Neigh-adjustment of the bed wall. This may be useful, if not necessary, for reasons of safety, for example to adjust the suspension bed as a child grows and becomes larger. Thus, said minimum volume may be adjusted to a maximum volume defined by the bed wall, by the bed bottom and by the upper edge of the bed wall when located at its largest distance from the bed bottom.

As an alternative or addition, the width and/or the length of the bed wall and the bed bottom may be adjustable for respective width-adjustment and/or length-adjustment thereof.

As a further alternative or addition, and for height-adjustment of the bed wall, the bed wall may be provided with at least one connection means structured so as to be able to releasably connect a first horizontally-extending portion of the bed wall to at least one second horizontally-extending portion of the bed wall.

Advantageously, the first horizontally-extending portion of the bed wall may be located at the upper edge of the bed wall, whereas said second horizontally-extending portion of the bed wall advantageously may be located one or several places located between the upper and lower edges of the bed wall.

As an example, said connection means may be comprised of a hook attached along the second horizontally-extending portion, which is located midway between the upper and lower edges of the bed wall. Several such hooks are suitably attached along this middle bed wall portion. Upon introductorily attaching all hooks to the upper edge (here representing said first horizontally-extending bed wall portion) of the bed wall, the bed will assume its minimum volume. If the volume of the bed is to be increased at a later stage, all hooks are disconnected from the upper edge of the bed wall, whereupon the bed bottom is lowered. The bed bottom may be lowered until the bed wall assumes its maximum height, whereby the bed assumes its maximum volume. If desirable, the bed bottom may also be lowered to a lesser degree by virtue of attaching the hooks in corresponding clasps, holes or similar, which are disposed along at least one additional horizontally-extending bed wall portion located between said middle bed wall portion and the upper edge of the bed wall. A corresponding height-adjustment of the bed wall may be achieved by using other types of connection means, for example button connections, zipper connections, hook-and-loop connections and alike.

As a further alternative or addition to the preceding features, and for width-adjustment of the bed wall and the bed bottom, they may be provided with at least one connection is means structured so as to be able to releasably connect a first vertically-extending portion of said at least one end wall to at least one second vertically-extending portion of the end wall, and also to releasably connect a corresponding first length-extending portion of the bed bottom to at least one second length-extending portion of the bed bottom.

This manner of adjustment is the same as for said height-adjustment of the bed wall. Herein, however, the difference lies in the fact that it is the at least one end wall of the bed wall that may be adjusted widthwise for adjustment of the bed volume.

As yet a further alternative or addition to the preceding features, and for length-adjustment of the bed wall and the bed bottom, they may be provided with at least one connection means structured so as to be able to releasably connect a first vertically-extending portion of said side walls to at least one second vertically-extending portion of the side walls, and also to releasably connect a corresponding first width-extending portion of the bed bottom to at least one second width-extending portion of the bed bottom.

Also this manner of adjustment is the same as for said height-adjustment of the bed wall. Herein, the difference lies in the fact that it is the side walls of the bed wall that may be adjusted lengthwise for adjustment of the bed volume.

Said connection means (of which some have already been mentioned) may comprise at least one of the following types of connections:

a zipper connection;
a hook-and-loop connection;
a quick release connection;
a buckle connection comprising a strap and an associated buckle for releasable attachment and length-adjustment of the strap;
a hook connection for releasable attachment of a hook to an edge, a clasp or a hole associated with the bed wall;
a button connection for releasable attachment of a button in a button-hole loop or a hole associated with the bed wall;
a hinge connection comprising a hinge and an associated locking device for releasable folding of the hinge connection; and
a fold connection comprising a fold and an associated lacing arrangement connecting the edges of the fold for releasable contraction and adjustment of the fold edges and hence the fold.

Said hook connection may be comprised of only one hook. The hook connection may also be comprised of a hook connected to a strap or similar. The same applies to said button connection. Preferably, the length of the strap is adjustable for length-adjustment thereof. The strap may also have a fixed length, for example half the height of the bed wall, possible some other suitable length.

Said hinge connection and locking device is considered most suitable in the event that the bed wall and/or the bed bottom include(s) relatively inflexible and stiff materials, elements and/or structures which, for allowing them to be folded and unfolded, require some type of link connection. This appears to be of most interest in the event that the suspension bed is of a fully or partially self-supporting design. For example, said locking device may be comprised of locking clips, a screw connection, a hook-and-loop connection and alike for releasable locking of links in the hinge connection.

Said fold connection with a fold and a lacing arrangement, however, is considered most suitable in the event that the bed wall and/or the bed bottom include(s) relatively flexible and pliable materials, elements and/or structures capable of being folded and unfolded. Typically, the lacing arrangement may comprise a lace carried in a criss-cross pattern through holes, for example an eye, disposed along each fold edge for releasable contraction of the fold edges relative to one another. Such a fold connection, and also a zipper connection, will be described in further detail in the subsequent embodiment examples.

Said buckle connection, which comprises a strap and an associated buckle, may be of the same type as is used, for example, for releasable attachment and length-adjustment of the carry straps on a rucksack or similar.

In an alternative embodiment, said support structure for the bed may include at least one support pole, wherein a first horizontally-extending portion and also at least one second horizontally-extending portion of the bed wall is provided with at least one attachment means structured so as to be able to be releasably attached to said support pole. Thereby, the height of the bed wall may be determined by attaching said support pole to the attachment means at the desired horizontally-extending portion of the bed wall, whereby the height of the bed wall is adjustable.

For example, said attachment means may comprise at least one of the following types of means for releasable connection to said support pole;

a loop passage;

a clasp; and a ring.

Other and similar attachment means may also be used.

Said subsequent embodiment examples will describe, among other things, a suspension bed, the support structure of which includes two parallel support poles structured so as to be able to be connected to a corresponding loop passage disposed along each long side of the bed wall.

Yet further, the present suspension bed advantageously may comprise at least one wall portion of the bed wall being releasable from the remainder of the bed wall for sideways access to the inside of the bed. Thus, said releasable wall portion of the bed wall may be structured so as to be foldable downwards and/or upwards, for example by means of suitable zipper connections, button connections or similar. Alternatively, said releasable wall portion of the bed wall may be structured so as to be tearable and attachable, for example by means of suitable hook-and-loop connections or similar.

Moreover, at least one wall portion of the bed wall may be formed from a transparent material for visual access to the inside of the bed, for example for inspection of the contents of the bed.

Furthermore, the bed bottom may include at least two bottom layers for insertion of a supporting bottom plate therebetween. The bottom plate may form a part of said support structure for the bed, and the bottom plate may be removed in connection with collapsing of the bed.

SHORT DESCRIPTION OF THE DRAWINGS

Subsequently, two non-limiting embodiment examples of the present suspension bed are described whilst referring to the accompanying figures, in which.

Figure 2:
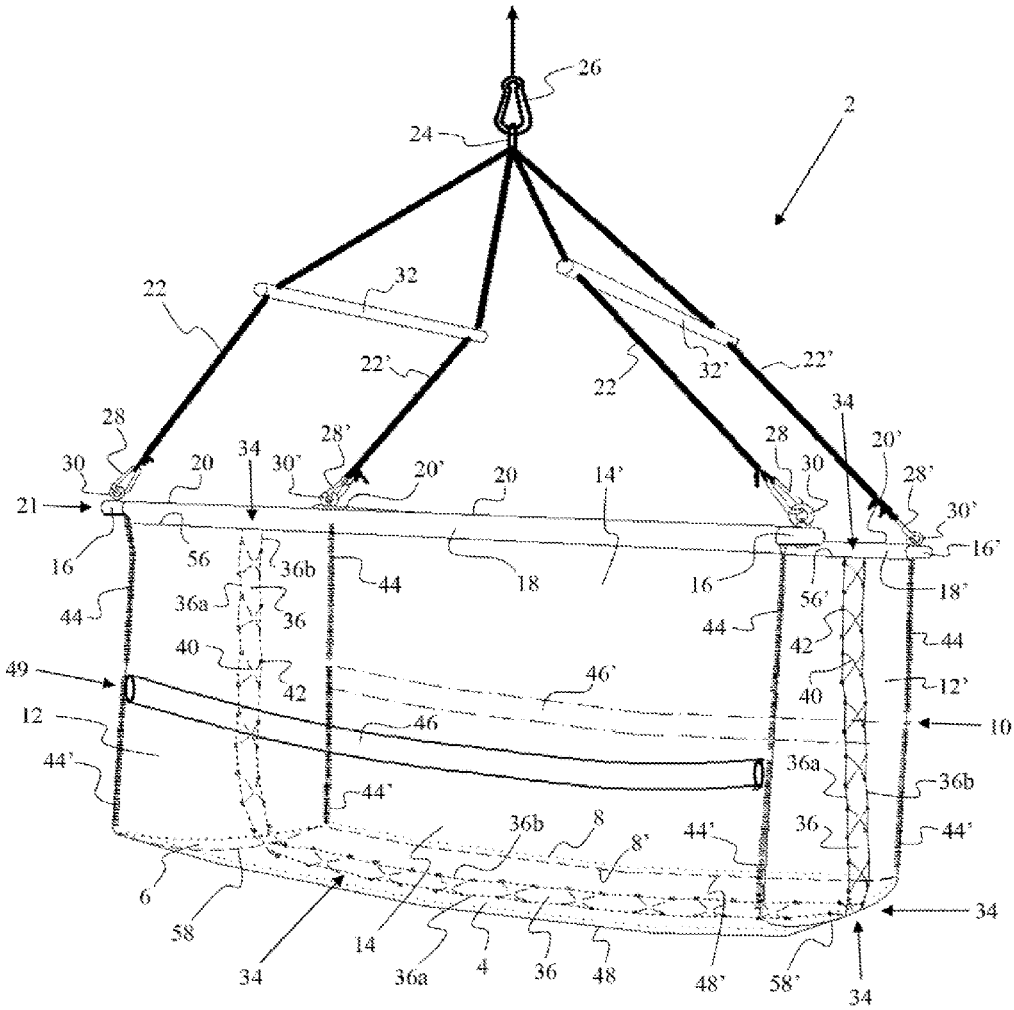
FIG. 2 shows the suspension bed according to FIG. 1, but wherein the bed wall and the bed bottom also have been adjusted widthwise to a maximum width by means of a fold connection and an associated lacing arrangement.
Figure 3:
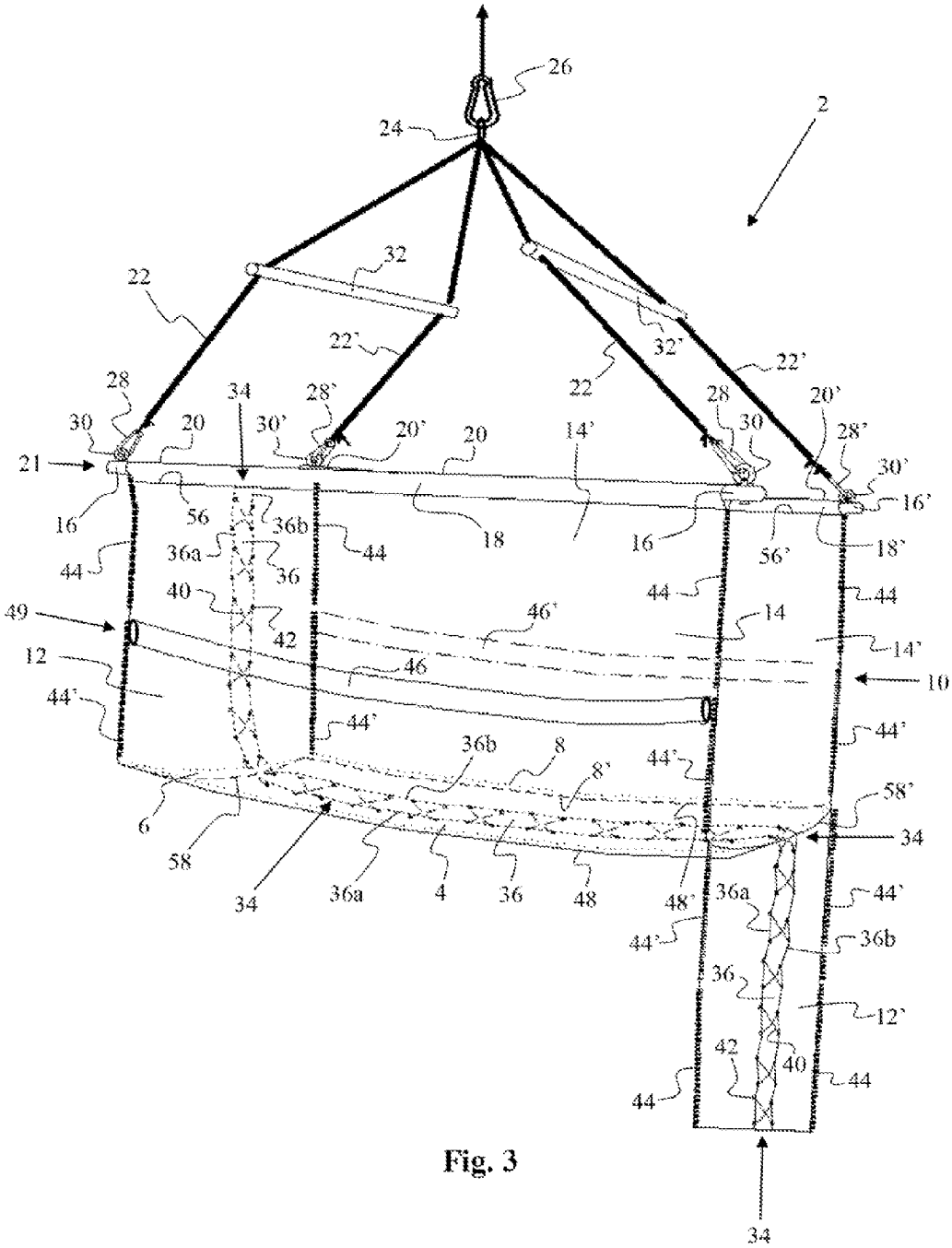
FIG. 3 shows the suspension bed according to FIG. 2, but wherein one end wall of the bed wall has been folded down by means of a zipper connection.
Figure 4:
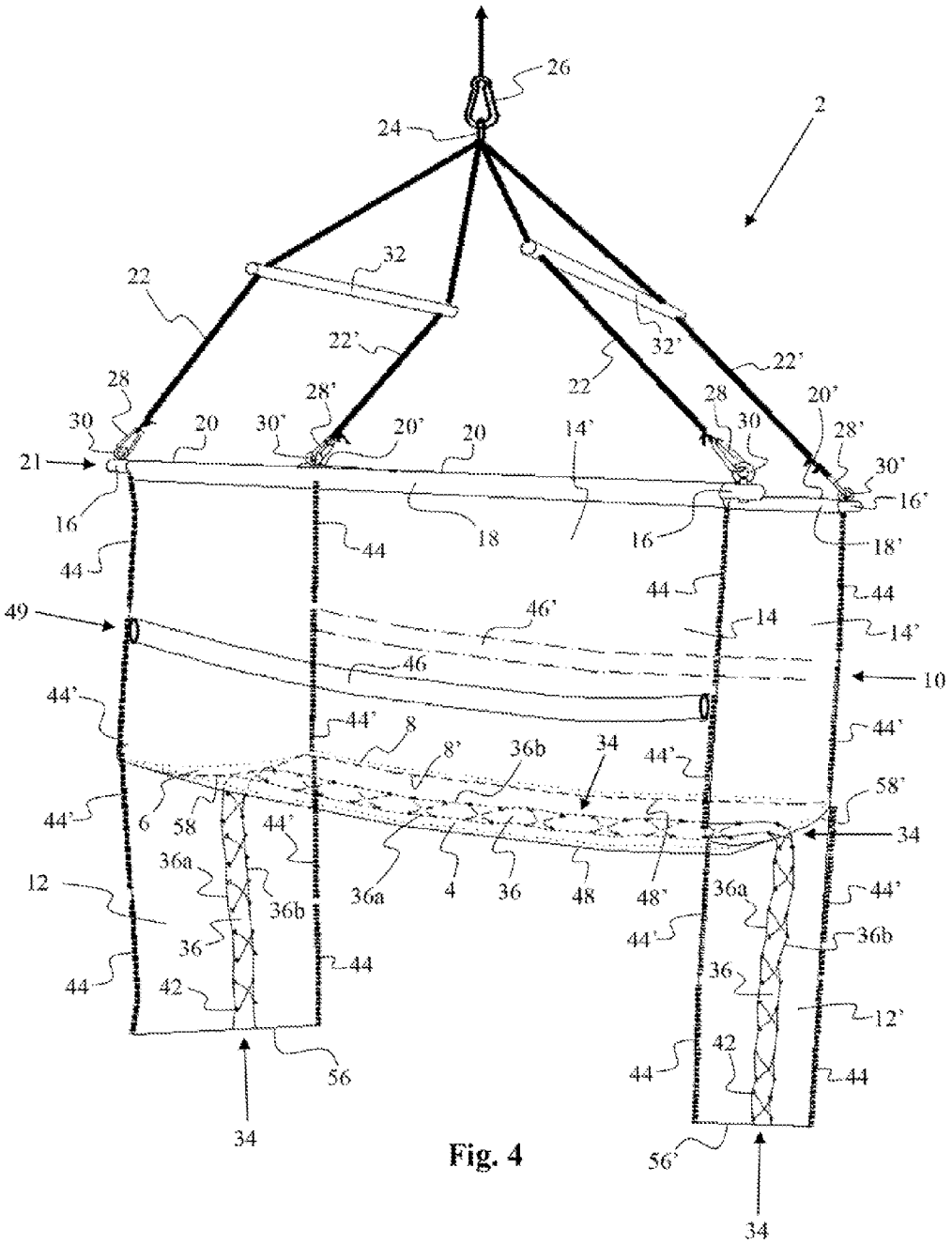
FIG. 4 shows the suspension bed according to FIG. 2, but wherein two end walls of the bed wall have been folded down by means of respective zipper connections.
Figure 6:
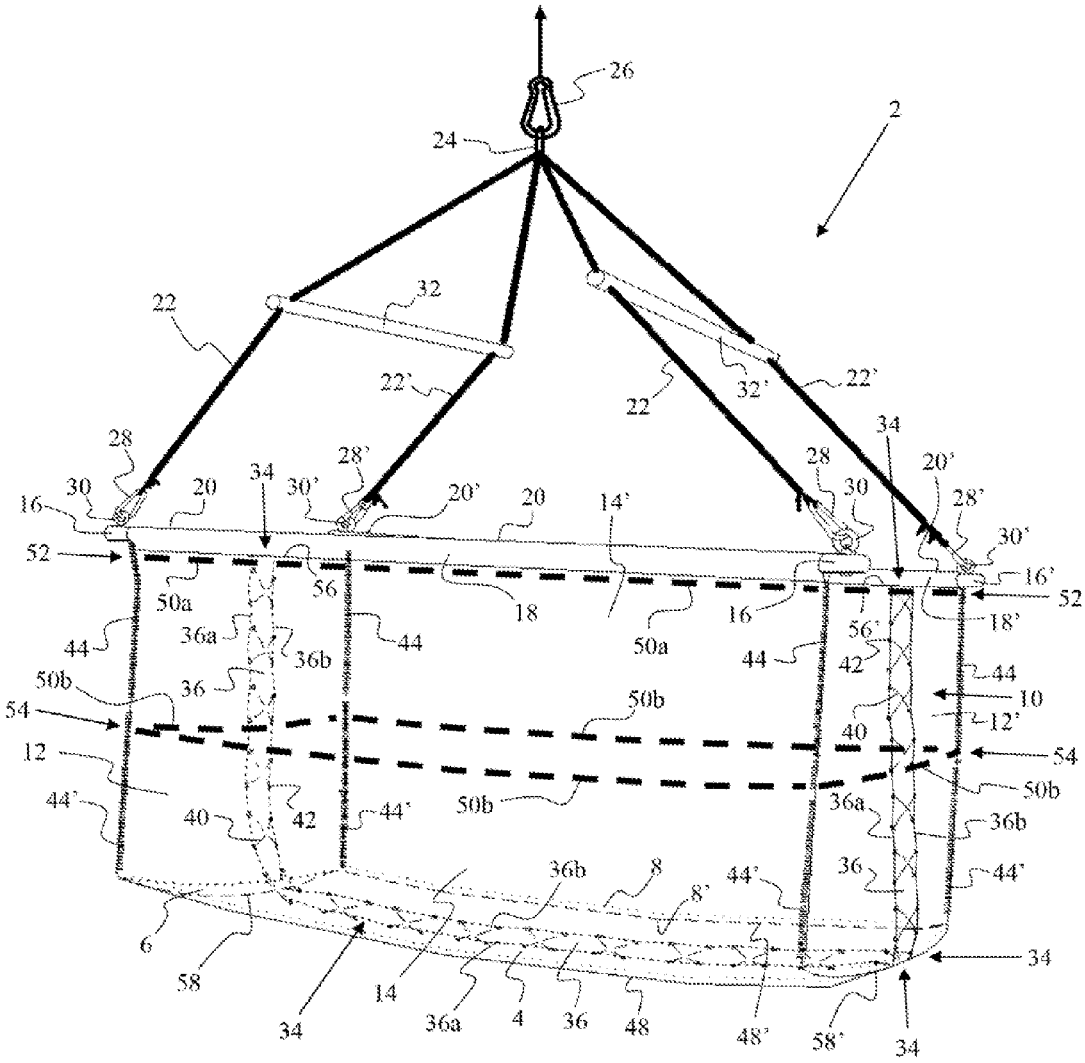
Figure 7:
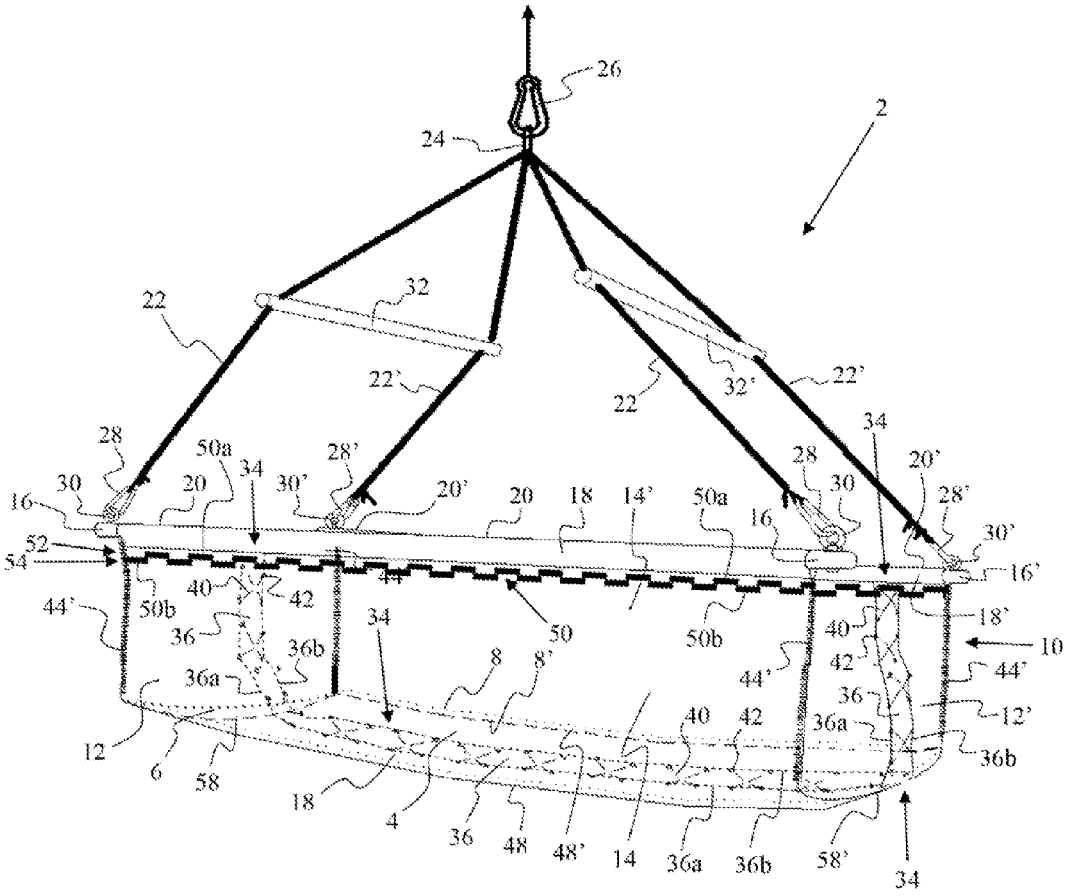

FIG. 6 shows a perspective view of a second embodiment of a collapsible suspension bed according to the invention resembling the embodiment according to FIG. 2, but wherein the bed wall is provided with a zipper connection structured so as to be able to releasably connect the lower and upper edges of the bed wall for height-adjustment thereof, the figure showing the zipper connection in a disconnected state, whereby the bed wall assumes its maximum height; and FIG. 7 shows the suspension bed according to FIG. 6, but wherein the zipper connection is shown in a connected state where the lower and upper edges of the bed wall are connected, whereby the bed wall assumes its minimum height.

Figure 1:
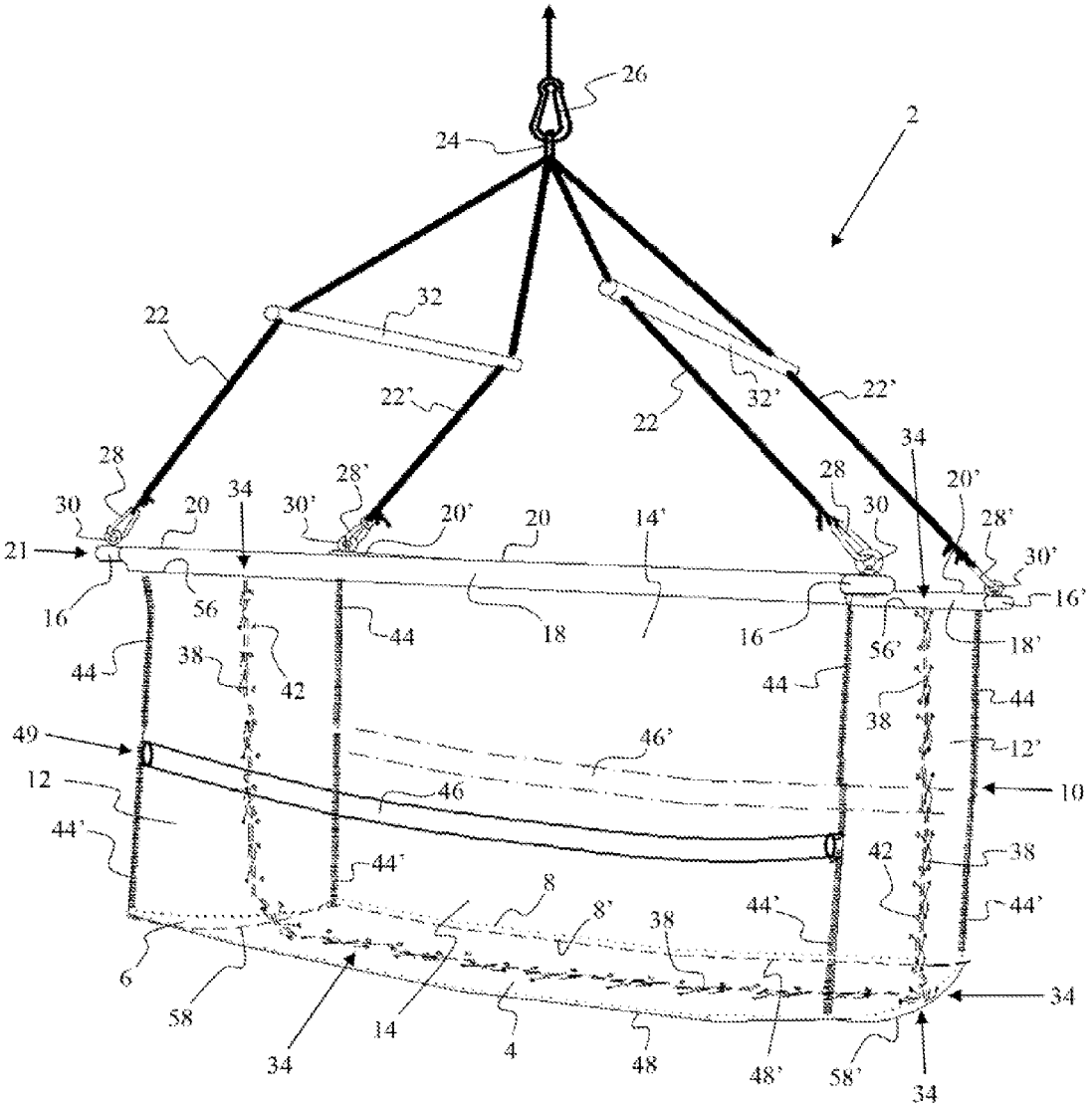
FIG. 1 shows a perspective view of a first embodiment of a collapsible suspension bed according to the invention, wherein the bed comprises, among other things, a suspension and two support poles releasably connected to corresponding loop passages at an upper edge of the bed wall, whereby the bed wall assumes its maximum height.
Figure 8:
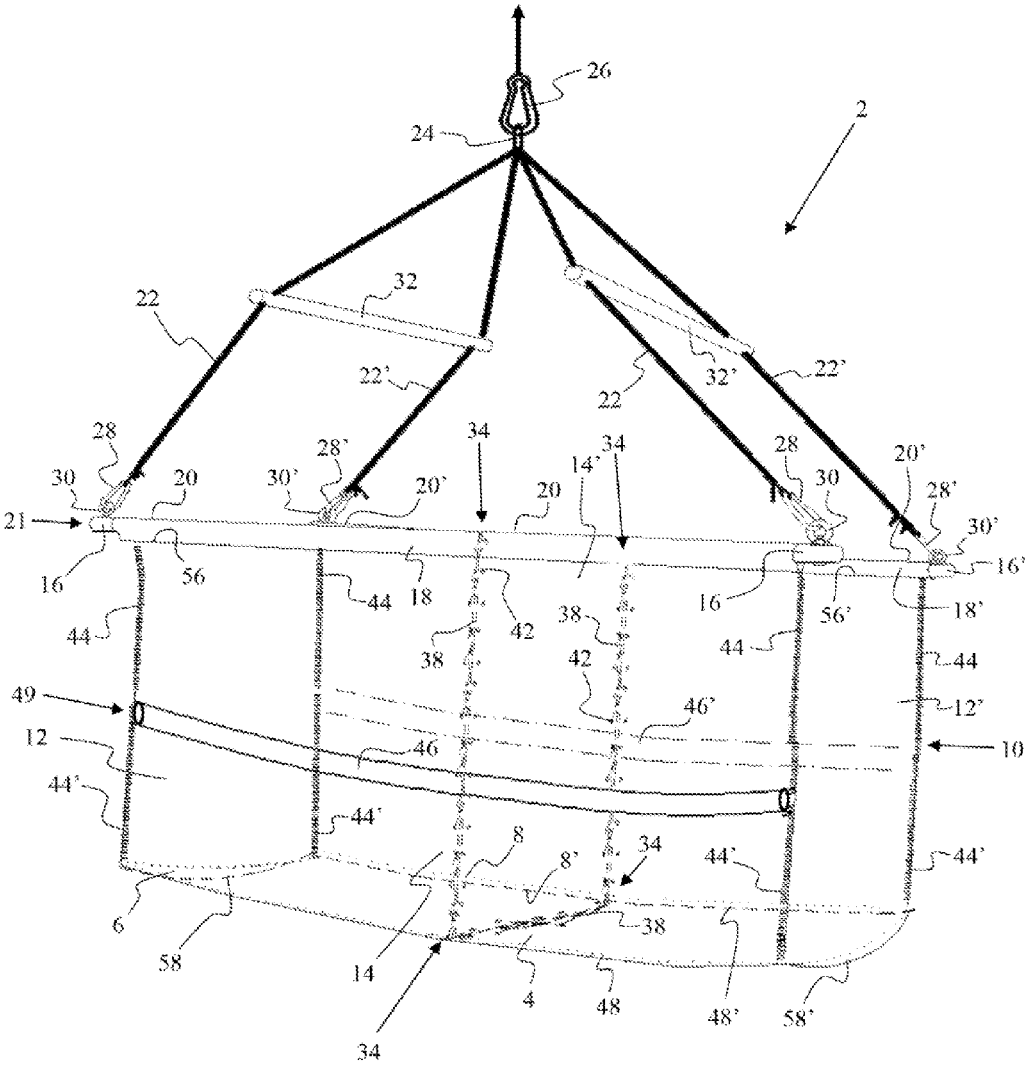

FIG. 8 shows a perspective view of a third embodiment of a collapsible suspension bed resembling the embodiment according to FIG. 1, but including connection means structured so as to be able to releasably connect a first vertically-extending portion of the side walls to at least one second vertically-extending portion of the side walls.

The attached figures are somewhat simplified and show only essential elements of the bed. The shape, relative dimensions and mutual positions of the elements may also be somewhat distorted. Hereinafter, identical, equivalent or corresponding details in the figures will be given substantially the same reference numeral.

DESCRIPTION OF AN EMBODIMENT EXAMPLE OF THE INVENTION

FIGS. 1-5 show a first embodiment of a collapsible suspension bed 2 according to the invention having a rectangular shape and being formed from a flexible and strong textile material.

Among other things, the bed 2 comprises a double bed bottom 4 is including a compartment 6 between two bottom layers 8, 8' for insertion of a supporting bottom plate (not shown) therebetween.

The bed 2 also comprises a bed wall 10 including two end walls 12, 12' and two side walls 14, 14' releasably connected to one another.

Yet further, the bed 2 comprises a support structure including said textile material, said bottom plate, two support poles 16, 16', each of which is releasably attached to an attachment means in the form of a loop passage 18, 18' disposed at an upper edge 20, 20' of each side wall 14, 14'. The upper edges 20, 20' represent a first horizontally-extending portion 21 of the bed wall 10. The support poles 16, 16' may be made of wood or some other stiff material of suitable type.

In addition, the bed 2 comprises a suspension means in the form of two strong ropes 22, 22' connecting the support poles 16, 16' to a mutual upper ring 24 or similar, which preferably is attached to a strong upper snap hook 26 for releasable suspension of the bed 2 (as indicated with an upwardly-directed arrow in the figures). Thereby, the bed 2 is arranged as a cradle capable of rocking back and forth if desirable. The rope 22 is releasably attached to each end of the support pole 16 by means of respective lower snap hooks 28 connected to respective eye screws 30, which are releasably attached to the support pole 16. Correspondingly, the rope 22' is releasably attached to each end of the is support pole 16' by means of respective lower snap hooks 28' connected to respective eye screws 30', which are attached to the support pole 16'. The suspension means also comprises two cross poles 32, 32' disposed at a distance from the support poles 16, 16', and which are attached between the ropes 22, 22' at each side of the upper snap hook 26. Together with said bottom plate, the cross poles 32, 32' serve to keep said side walls 14, 14' separated and hence to keep the bed 2 in an expanded position of use. The cross poles 32, 32' may also be made from wood or some other stiff material of suitable type. Moreover, other types of suspension means may also be used, including those referred to in the aforementioned publications of prior art.

For width-adjustment of the two end walls 12, 12' of the bed bottom 4 and the bed wall 10, they are provided with a connection means in the form of a fold connection 34 comprising a fold 36 and an associated lacing arrangement 38 connecting the edges 36*a* and 36*b* of the fold 36. By so doing, the fold edges 36*a*, 36*b* may be releasably contracted for suitable width-adjustment thereof. Herein, said lacing arrangement 38 comprises a lace 40 carried in a criss-cross pattern through eyes 42 disposed along each fold edge 36*a*, 36*b*. In this embodiment, the fold connection 34 extends along the bed bottom 4 and up along each end wall 12, 12'. Thus, the one fold edge 36*a* represents a first vertically-extending portion of each end wall 12, 12' and also a first length-extending portion of the bed bottom 4, whereas the other fold edge 36*b* represents a second vertically-extending portion of each end wall 12, 12' and also a second length-extending portion of the bed bottom 4. This width-adjustment arrangement is shown in all FIGS. 1-7. In FIG. 1, the fold connection 34 is shown laced together, whereby the bed wall 10 and the bed bottom 4 assume their smallest width. In FIGS. 2-7, however, the lacing arrangement 38 is shown in a loosened state where the fold connection 34 is expanded, whereby the bed wall 10 and the bed bottom 4 assume their largest width. Said fold connection 34 may just as well be comprised of suitable connection means, for example of the aforementioned types.

As mentioned, the end walls 12, 12' and the side walls 14, 14' of the bed wall 10 may be releasably connected to one another. Thereby, one (cf. FIG. 3) or both (cf. FIG. 4) end walls 12, 12' may be released from the side walls 14, 14' and be lowered for sideways access to the inside of the bed 2. In this embodiment, the end walls 12, 12' and the side walls 14, 14' are releasably connected by means of respective vertically-extending zipper connections 44 and 44' disposed at an upper half and a lower half, respectively, of the bed wall 10. This has been done to allow sideways access to the inside of the bed 2 both when the bed wall 10 assumes its minimum height (cf. FIG. 5), and when assuming its maximum height (cf. FIGS. 1-4 and 6-7). Said zipper connections 44 and 44' may just as well be comprised of other suitable connection means, for example hook-and-loop connections, button connections or similar.

Figure 5:
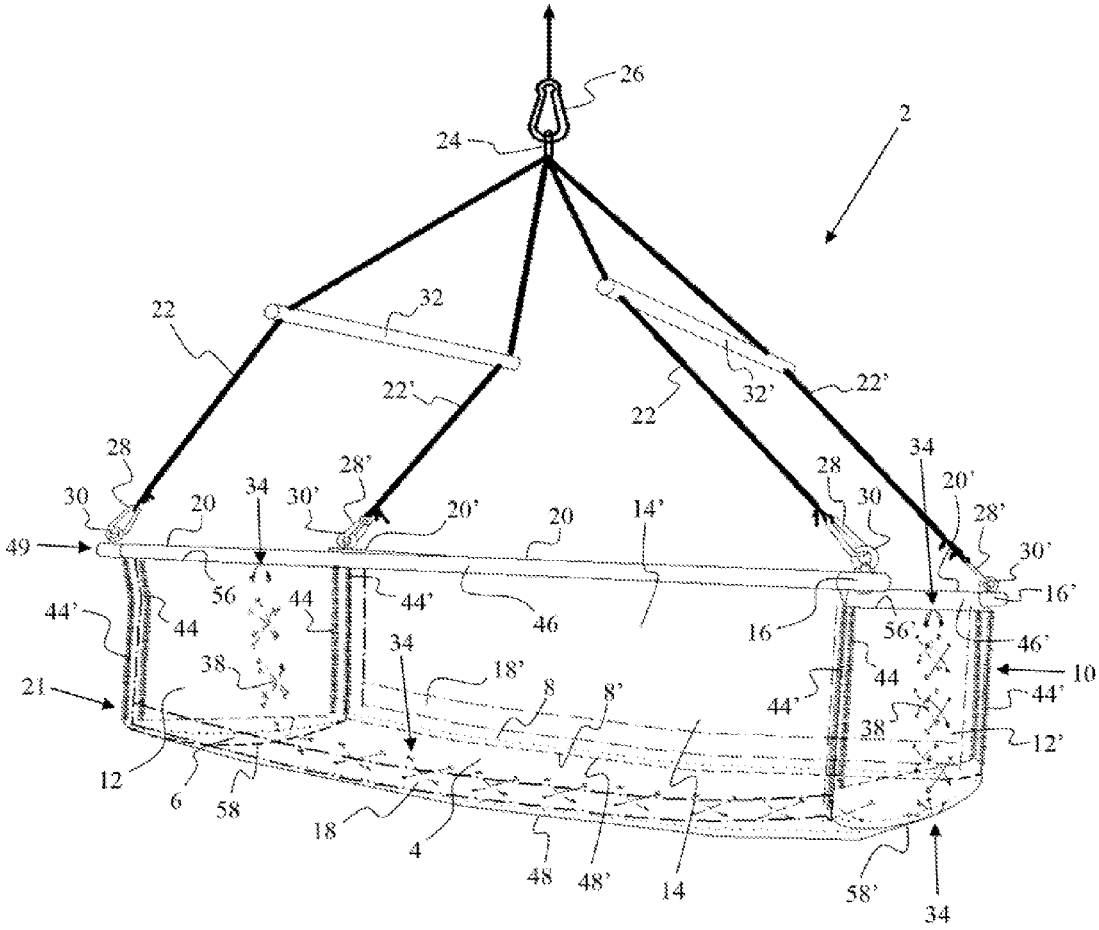
FIG. 5 shows the suspension bed according to FIG. 2, but wherein the bed wall has been adjusted heightwise by virtue of said support poles being connected to corresponding loop is passages located between the upper and lower edges of the bed wall, whereby the bed wall assumes its minimum height.

The suspension bed according to FIGS. 1-5 also have side walls 14, 14' provided each with a further attachment means in the form of a loop passage 46, 46' disposed between said upper edge 20, 20' and a lower edge 48, 48' of each side wall 14, 14'. The loop passages 46, 46' are disposed along a second horizontally-extending portion 49 of the bed wall 10. These loop passages 46, 46' are structured so as to be able to be releasably connected to respective support poles 16, 16', and in the same manner as for the loop passages 18, 18' at said first horizontally-extending portion 21 of the bed wall 10 (i.e. the upper edge 20, 20' of the side walls 14, 14'). By moving the support poles 16, 16' from the upper loop passages 18, 18' to the lower loop passages 46, 46', and also by folding said upper half of the bed wall 10 inwards or outwards from the bed 2, the bed wall 10 will assume its minimum height, as shown in FIG. 5. If desirable, the bed wall 10 may also comprise several other horizontally-extending portions provided with such loop passages for height-adjustment of the bed wall 10.

FIGS. 6 and 7 show a second embodiment of a collapsible suspension bed 2 according to the invention. In distinction from the previous embodiment, the bed 2 according to this embodiment is only provided with the aforementioned upper loop passages 18 and 18' within which the support poles 16, 16' are releasably placed.

The bed wall 10, however, is provided with a connection means in the form of a horizontally-extending zipper connection 50 comprising two cooperating zipper halves 50*a* and 50*b*. The zipper connection 50 is structured so as to be able to releasably connect a first horizontally-extending portion 52 of the bed wall 10 to a second horizontally-extending portion 54 of the bed wall 10 for height-adjustment of the bed wall 10. In this embodiment, the first horizontally-extending portion 52 is located at the upper edge of the bed wall 10, whereas the second horizontally-extending portion 54 is located midway between the upper and lower edges of the bed wall 10. The upper edge of the bed wall 10 comprises said upper edges 20, 20' of the side walls 14, 14' and also upper edges 56, 56' of the end walls 12, 12', whereas the lower is edge of the bed wall 10 comprises said lower edges 48, 48' of the side walls 14, 14' and also lower edges 58, 58' of the end walls 12, 12'. Both the zipper connection 50 as well as the first and second horizontally-extending portions 52, 54 extend around the side walls 14, 14' and the end walls 12, 12'. The one zipper half 50*a* is attached along the first (upper) horizontally-extending portion 52, whereas the other zipper half 50*b* is attached along the second (lower) horizontally-extending portion 54. In addition, the zipper connection 50 is segmented by virtue of the side walls 14, 14' and the end walls 12, 12' being provided with respective segments of the zipper connection 50. Said the zipper connection 50 may just as well be comprised of other suitable connection means, for example of the aforementioned types.

FIG. 6 shows the zipper connection 50 in a disconnected state, whereby the bed wall 10 assumes its maximum height. By lifting the bed bottom 4 up and connecting the lower zipper half 50*b* together with the upper zipper half 50*a*, and also by folding the upper half of the bed wall 10 inwards or outwards from the bed 2, the bed wall 10 will assume its minimum height, as shown in FIG. 7. Furthermore, FIG. 7 is drawn somewhat simplified given that folds, which arise when folding the upper half of the bed wall 10 inwards, are not shown in the figure.

FIG. 8 shows a perspective view of a third embodiment of a collapsible suspension bed resembling the embodiment according to FIG. 1, but wherein the fold connection 34 is structured so that the side walls of the bed wall may be adjusted lengthwise for adjustment of the bed volume. This manner of adjustment is the same as, for example, the height-adjustment of the bed wall.

The invention claimed is:

1. A collapsible suspension bed comprising a bed bottom; a bed wall including at least one end wall and at least two side walls; at least one support structure for the bed; and at least one suspension means connected to the support structure for suspension of the bed wherein the bed is structured in at least one of the following manners to allow the volume of the bed to be adjustable for volume-adjustment thereof:

(A) the bed wall, for height-adjustment thereof, is provided with at least one connection means structured so as to be able to connect a first horizontally-extending portion of the bed wall in a releasable manner to at least one second horizontally-extending portion of the bed wall;

(B) the bed wall and the bed bottom, for width-adjustment thereof, is provided with at least one connection means structured so as to be able to connect a first vertically-extending portion of said at least one end wall in a releasable manner to at least one second vertically-extending portion of the end wall, and also to connect a corresponding first length-extending portion of the bed bottom in a releasable manner to at least one second length-extending portion of the bed bottom; and (C) the bed wall and the bed bottom, for length-adjustment thereof, is provided with at least one connection means structured so as to be able to connect a first vertically-extending portion of said side walls in a releasable manner to at least one second vertically-extending portion of the side walls, and also to connect a corresponding first width-extending portion of the bed bottom in a releasable manner to at least one second width-extending portion of the bed bottom.

2. The collapsible suspension bed according to claim 1, wherein said connection means comprises at least one of the following types of connections:

a zipper connection;

a hook-and-loop connection;

a quick release connection;

a buckle connection comprising a strap and an associated buckle for releasable attachment and length-adjustment of the strap;

a hook connection for releasable attachment of a hook to an edge, a clasp or a hole associated with the bed wall;

a button connection for releasable attachment of a button in a button-hole loop or a hole associated with the bed wall;

a hinge connection comprising a hinge and an associated locking device for releasable folding of the hinge connection; and a fold connection comprising a fold and an associated lacing arrangement connecting the edges of the fold for releasable contraction and adjustment of the fold edges and hence the fold.

3. The collapsible suspension bed according to claim 1 wherein said support structure for the bed includes at least one support pole; and wherein a first horizontally-extending portion and also at least one second horizontally-extending portion of the bed wall is provided with at least one attachment means structured so as to be able to be releasably attached to said support pole;

whereby the height of the bed wall may be determined by attaching said support pole to the attachment means at the desired horizontally-extending portion of the bed wall, whereby the height of the bed wall is adjustable.

4. The collapsible suspension bed according to claim 3, wherein said attachment means comprises at least one of the following types of means for releasable connection to said support pole;

a loop passage;

a clasp; and a ring.

5. The collapsible suspension bed according to claim 1 wherein the suspension means comprises cross poles disposed at a distance from the bed wall for contributing to keep the bed expanded.

6. The collapsible suspension bed according to claim 1 wherein the bed bottom has one of the following shapes:

square shape;

rectangular shape;

triangular shape;

oval shape; and circular shape.

7. The collapsible suspension bed according to claim 1 wherein the bed bottom comprises a supporting bottom plate.

8. The collapsible suspension bed according to claim 1 wherein the bed is of a fully or partially self-supporting design, at least when the bed is in position of use.

9. The collapsible suspension bed according to claim 1 wherein at least one wall portion of the bed wall is releasable from the remainder of the bed wall.

10. The collapsible suspension bed according to claim 1 wherein at least one wall portion of the bed wall is formed from a transparent material.

* * * * *